US011306522B2

(12) United States Patent
Holzapfel et al.

(10) Patent No.: US 11,306,522 B2
(45) Date of Patent: Apr. 19, 2022

(54) FURNITURE FITTING

(71) Applicant: Julius Blum GmbH, Hoechst (AT)

(72) Inventors: Andreas Holzapfel, Bregenz (AT); Philip Schluge, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 36 days.

(21) Appl. No.: 16/863,011

(22) Filed: Apr. 30, 2020

(65) Prior Publication Data

US 2020/0256101 A1 Aug. 13, 2020

Related U.S. Application Data

(63) Continuation of application No. PCT/AT2018/060254, filed on Oct. 22, 2018.

(30) Foreign Application Priority Data

Nov. 24, 2017 (AT) ..... A 50980/2017

(51) Int. Cl.
*E05D 7/04* (2006.01)
*E05D 3/06* (2006.01)
*E05D 13/00* (2006.01)

(52) U.S. Cl.
CPC ..... *E05D 7/0407* (2013.01); *E05D 3/06* (2013.01); *E05D 13/00* (2013.01); *E05Y 2900/20* (2013.01)

(58) Field of Classification Search
CPC ..... E05F 1/1276; E05F 1/1246; E05F 1/1253; E05F 1/1261; E05F 1/1058; E05F 1/1075; E05F 5/02; E05F 3/20; E05F 11/54; E05D 3/02; E05D 3/06; E05D 3/16; E05D 11/00; E05D 15/40; E05D 13/00; E05D 2003/163; E05D 5/00; E05D 5/02; E05D 5/0276; E05D 5/046; E05D 7/0407; E05D 2007/0446; E05Y 2201/10;
(Continued)

(56) References Cited

U.S. PATENT DOCUMENTS 1,417,639 A * 5/1922 Sterner ..... A47B 91/028 248/188.4
2,938,690 A * 5/1960 Castle ..... F16B 2/08 248/27.1

(Continued)

FOREIGN PATENT DOCUMENTS

AT 352 329 9/1979
AT 503661 12/2007

(Continued)

OTHER PUBLICATIONS

International Search Report dated Jan. 7, 2019 in International (PCT) Application No. PCT/AT2018/060254.

(Continued)

*Primary Examiner* — Chuck Y Mah
(74) *Attorney, Agent, or Firm* — Wenderoth, Lind & Ponack, L.L.P.

(57) ABSTRACT

A furniture fitting includes at least one rotatably mounted screw for fixing the furniture fitting to a furniture part. The furniture fitting further includes at least one drive element separate from the screw, and the drive element is movement-coupled to the screw and has a tool receiving device. The at least one screw is configured to be driven by rotating the tool receiving device with the aid of a tool.

14 Claims, 6 Drawing Sheets

(58) Field of Classification Search
CPC ..... E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476; Y10T 16/5321; Y10T 16/5322; Y10T 16/53225
See application file for complete search history.

(56) References Cited

U.S. PATENT DOCUMENTS

| | | | | | |
|---|---|---|---|---|---|
| 4,408,923 | A * | 10/1983 | Kubler | F16B 12/2063 | 403/20 |
| 4,685,848 | A * | 8/1987 | Langer | B25B 13/00 | 411/378 |
| 4,869,614 | A * | 9/1989 | Fisher | F16B 12/2063 | 403/8 |
| 4,991,805 | A * | 2/1991 | Solak | F16M 7/00 | 248/188.4 |
| 5,169,334 | A * | 12/1992 | Makita | H01R 13/6215 | 439/359 |
| 5,295,756 | A * | 3/1994 | Ohta | H01R 13/6215 | 439/364 |
| 5,480,253 | A * | 1/1996 | Ljungberg | A47B 87/008 | 312/111 |
| 5,701,636 | A * | 12/1997 | Jahnke | E05D 7/0423 | 16/237 |
| 6,205,617 | B1 * | 3/2001 | Held | E05D 7/0407 | 16/236 |
| 6,257,796 | B1 | 7/2001 | Salice | | |
| 6,953,313 | B2 * | 10/2005 | Tylosky | F16B 7/06 | 403/322.2 |
| 7,334,293 | B2 * | 2/2008 | Erickson | E05D 7/0423 | 16/243 |
| 7,552,511 | B2 * | 6/2009 | Campbell | E05D 7/0423 | 16/236 |
| 7,594,301 | B2 * | 9/2009 | Krajenke | E05D 7/0423 | 296/76 |
| 7,694,389 | B2 * | 4/2010 | Erickson | E05D 7/0423 | 16/243 |
| 8,381,354 | B2 * | 2/2013 | Haab | E05D 15/0656 | 16/91 |
| 8,740,935 | B2 * | 6/2014 | Cohen | A61B 17/888 | 606/213 |
| 9,140,289 | B2 | 9/2015 | Sutterluetti | | |
| 10,076,367 | B2 * | 9/2018 | Moskowitz | A61B 17/0642 | |
| 10,087,971 | B1 * | 10/2018 | Bergan | F16B 23/0061 | |
| 10,508,673 | B2 | 12/2019 | Haemmerle | | |
| 2004/0208690 | A1 | 10/2004 | Mauri | | |
| 2006/0241621 | A1 * | 10/2006 | Moskowitz | A61B 17/7064 | 623/17.11 |
| 2007/0049943 | A1 * | 3/2007 | Moskowitz | A61F 2/4611 | 606/279 |
| 2007/0143959 | A1 * | 6/2007 | Chung | E05D 7/0423 | 16/236 |
| 2014/0169912 | A1 | 6/2014 | Sutterluetti | | |
| 2015/0361705 | A1 * | 12/2015 | Folie | E05F 1/1058 | 312/319.6 |
| 2015/0377269 | A1 | 12/2015 | Haemmerle | | |
| 2019/0024690 | A1 | 1/2019 | Giovannetti | | |
| 2020/0063772 | A1 * | 2/2020 | Lin | E04B 1/40 | |

FOREIGN PATENT DOCUMENTS

| | | | |
|---|---|---|---|
| CN | 101438022 | | 5/2009 |
| CN | 203547350 | | 4/2014 |
| CN | 205349058 | | 6/2016 |
| DE | 297 21 068 | | 1/1998 |
| DE | 10 2007 049 143 | | 6/2008 |
| EP | 1159502 | | 3/2003 |
| GB | 2 028 914 | | 3/1980 |
| JP | 57-80708 | | 5/1982 |
| JP | 8-296383 | | 11/1996 |
| JP | 10-179297 | | 7/1998 |
| JP | 2001-140824 | | 5/2001 |
| JP | 2014-525551 | | 9/2014 |
| JP | 2016-509146 | | 3/2016 |
| KR | 10-1623483 | * | 5/2016 |
| WO | 2008/076089 | | 6/2008 |
| WO | 2013/029070 | | 3/2013 |
| WO | 2014/138760 | | 9/2014 |
| WO | 2017/167661 | | 10/2017 |
| WO | WO-2018149293 A1 * | | 8/2018 ..... E04B 1/40 |

OTHER PUBLICATIONS

Chinese Search Report dated Apr. 15, 2021 in corresponding Chinese Patent Application No. 201880075314.4.

* cited by examiner

FURNITURE FITTING

BACKGROUND OF THE INVENTION

The present invention relates to a furniture fitting comprising at least one rotatably mounted screw for fixing the furniture fitting to a furniture part. Moreover, the invention relates to a method for fixing such a furniture fitting to a furniture part.

WO 2013/029070 A1 and WO 2014/138760 A1 disclose furniture fittings configured to be alternatively fixed to opposing sidewalls of a furniture carcass by a screw. For this purpose, tool receiving devices are provided on both end regions of the screw, so that the screw, by rotating the first tool receiving device, can be screwed into the first sidewall or, alternatively, by rotating the second tool receiving device, can be screwed into the second sidewall. However, for mounting the furniture fitting, a relatively large manual effort is required. Moreover, a thickness of the furniture fitting, due to the tool receiving devices arranged on both ends of the screw, results relatively large.

SUMMARY OF THE INVENTION

It is an object of the present invention to propose a furniture fitting of the type mentioned in the introductory part, thereby avoiding the above-discussed drawbacks.

According to the invention, the furniture fitting includes at least one drive element separate from the screw, the drive element being movement-coupled to the screw and having a tool receiving device, wherein the at least one screw is configured to be driven by rotating the tool receiving device with the aid of a tool.

By virtue of the proposed construction, a plurality of advantages can be provided, namely:

- due to a drive element arranged laterally beside the screw, the construction of the furniture fitting can be configured so as to be flatter, because an arrangement of the tool receiving devices on both ends of the screw can be omitted,
- the drive element can be movement-coupled to the screw by a mechanical transmission (for example a gear transmission or a worm gear transmission), whereby there is the possibility to vary the transmission ratio. For example, the drive element can be driven by an electric screwdriver with a relatively large revolution speed, and the screw can then be driven into the furniture part with a corresponding reduced revolution speed but with a high torque,
- by the proposed construction, it is moreover possible that two or more screws of the furniture fitting are movement-coupled to the drive element, so that the two or more screws are configured to be driven by rotating the tool receiving device with the aid of the tool,
- by the proposed invention, it is eventually also possible that the at least one screw of the furniture fitting can be alternatively fixed on two opposing sidewalls of a furniture carcass.

According to an embodiment, the at least one drive element is rotationally supported about a first rotational axis, and the at least one screw is rotationally supported about a second rotational axis, and the first rotational axis and the second rotational axis are arranged so as to be laterally offset to one another. In this way, the furniture fitting can be configured with a flat design.

According to a further embodiment, the drive element and the at least one screw are movement-coupled to one another by cooperating tooth arrangements. For example, a first tooth arrangement can be arranged or formed on a peripheral surface of the drive element. A second tooth arrangement, on the contrary, can be arranged or formed on a head portion of the screw, the first and the second tooth arrangement being connected to one another, in particular also directly.

According to a further embodiment, the drive element and the screw are not only rotationally movement-coupled to one another, but also in a direction extending in a longitudinal, axial direction of the screw. This offers, for example, the possibility that the drive element can be moved, together with the screw, in a longitudinal direction of the screw, so that the screw can be screwed either into a first sidewall or, alternatively, into a second sidewall opposing the first sidewall of the furniture carcass. For example, such an axial movement-coupling between the drive element and the screw can be provided in such a way that the screw includes a first abutment surface and at least one second abutment surface spaced from each other in an axial direction of the screw, and a tooth arrangement of the drive element is received between the first and second abutment surface of the screw.

The method for fixing a furniture fitting to a furniture part is characterized by the following steps:

- a tool is introduced into the tool receiving device of the drive element,
- the drive element is rotated by rotating the tool receiving device with the aid of the tool,
- the at least one screw is driven by the movement-coupling between the drive element and the screw, and
- the furniture fitting is fixed to the furniture part by the at least one screw.

The furniture fitting can be configured, for example, as an actuating drive for furniture flaps, the actuating drive having at least one pivotally mounted actuating arm for driving a furniture part which is movably supported relative to a furniture carcass. The furniture drive can include a spring device for applying a force to the actuating arm and/or an electric drive for driving the actuating arm.

Alternatively, the furniture fitting can also be configured as a furniture hinge, as a drawer pull-out guide or as a supporting device for supporting at least one functional unit (for example a damping device for dampening a movement of the movable furniture part, a retraction device for retracting the furniture part into a closed end position relative to a furniture carcass, an ejection device (in particular a Touch-Latch-Device) for ejecting the movable furniture part from a closed end position into an open position).

The furniture fitting can include either a housing or, in the simplest case, also a mounting plate, and the housing or the mounting plate is configured to be fixed to a furniture part by the at least one rotationally supported screw of the furniture fitting.

BRIEF DESCRIPTION OF THE DRAWINGS

Further details and advantages of the present invention will be explained with the aid of the following description of figures, in which.

DETAILED DESCRIPTION OF THE INVENTION

Figure 1A:
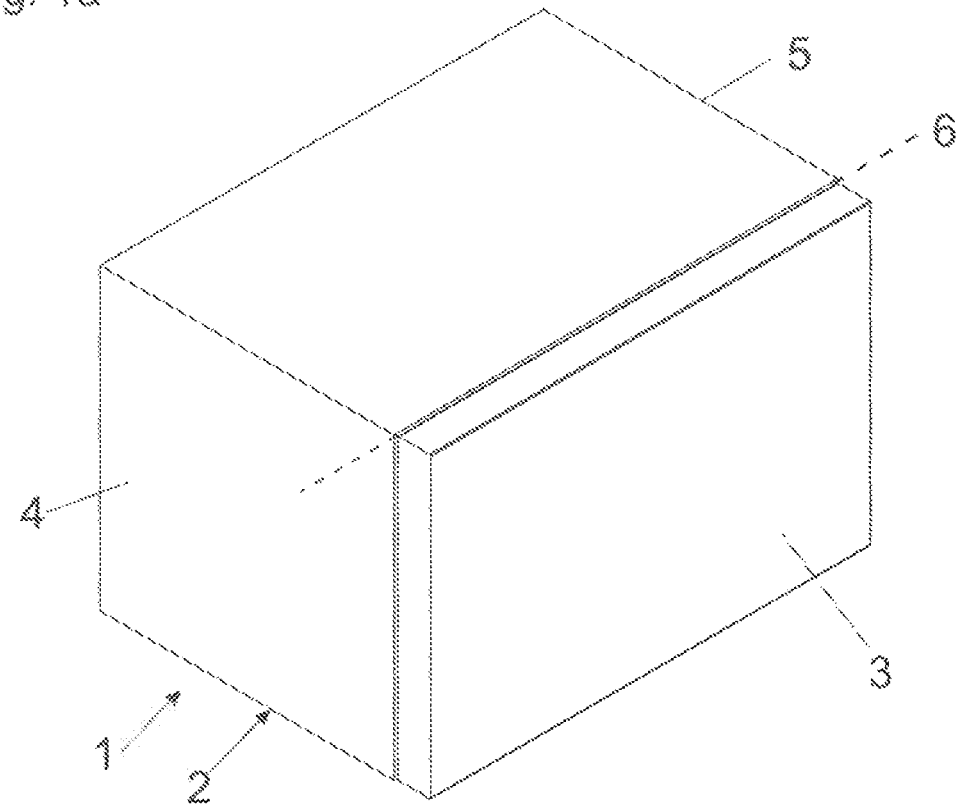
FIG. 1*a*, 1*b* are perspective views of an item of furniture having a furniture part movably supported relative to a furniture carcass, and the item of furniture with the furniture part hidden.

FIG. 1*a* shows a cupboard-shaped item of furniture 1 which can be configured, for example, as an upper cabinet in a kitchen. The item of furniture 1 includes a furniture carcass 2 having sidewalls 4, 5, and a movably supported furniture part 3 is pivotally supported relative to the furniture carcass 2 about a horizontally extending axis 6 in the mounted position. In FIG. 1*a*, the furniture part 3 is located in a vertical closed position in which the furniture carcass 2 is covered, and the furniture part 3 can be moved by a furniture fitting 7 between the closed position and an elevated open position relative to the furniture carcass 2.

Figure 1B:
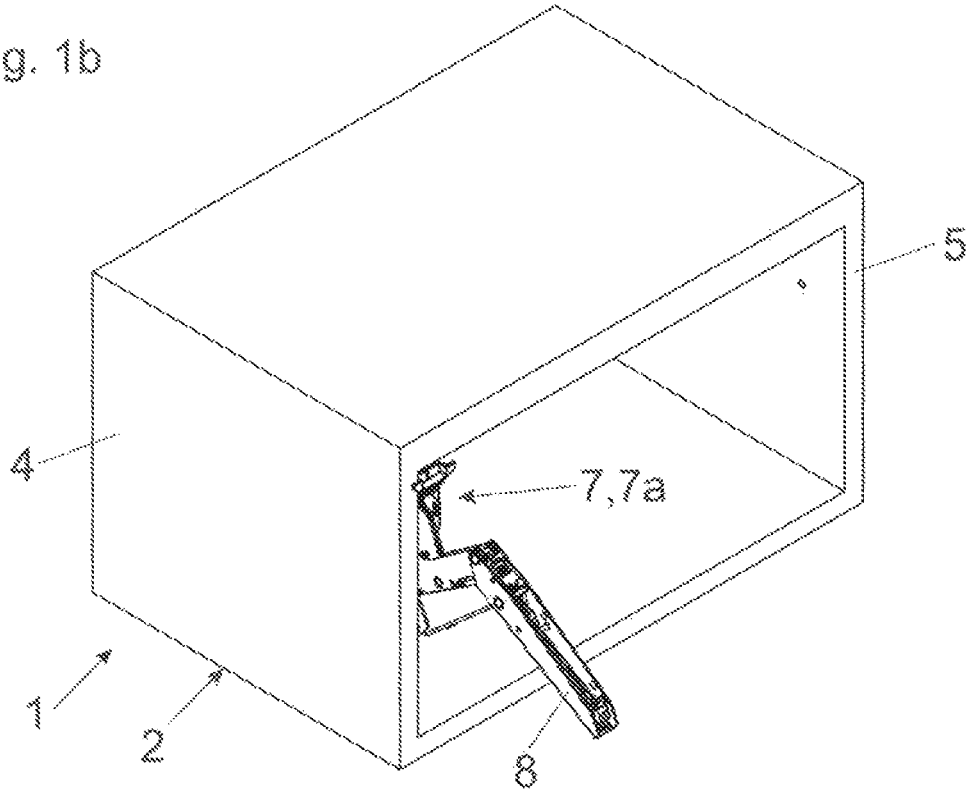

FIG. 1*b* shows the item of furniture 1 with the furniture part 3 hidden. A furniture fitting 7 for moving the furniture part 3 is fixed to the first sidewall 4. The furniture fitting 7, in the shown embodiment, is configured as an actuating drive 7*a* having at least one pivotally mounted actuating arm 8 configured to be connected to the furniture part 3.

Figure 2:
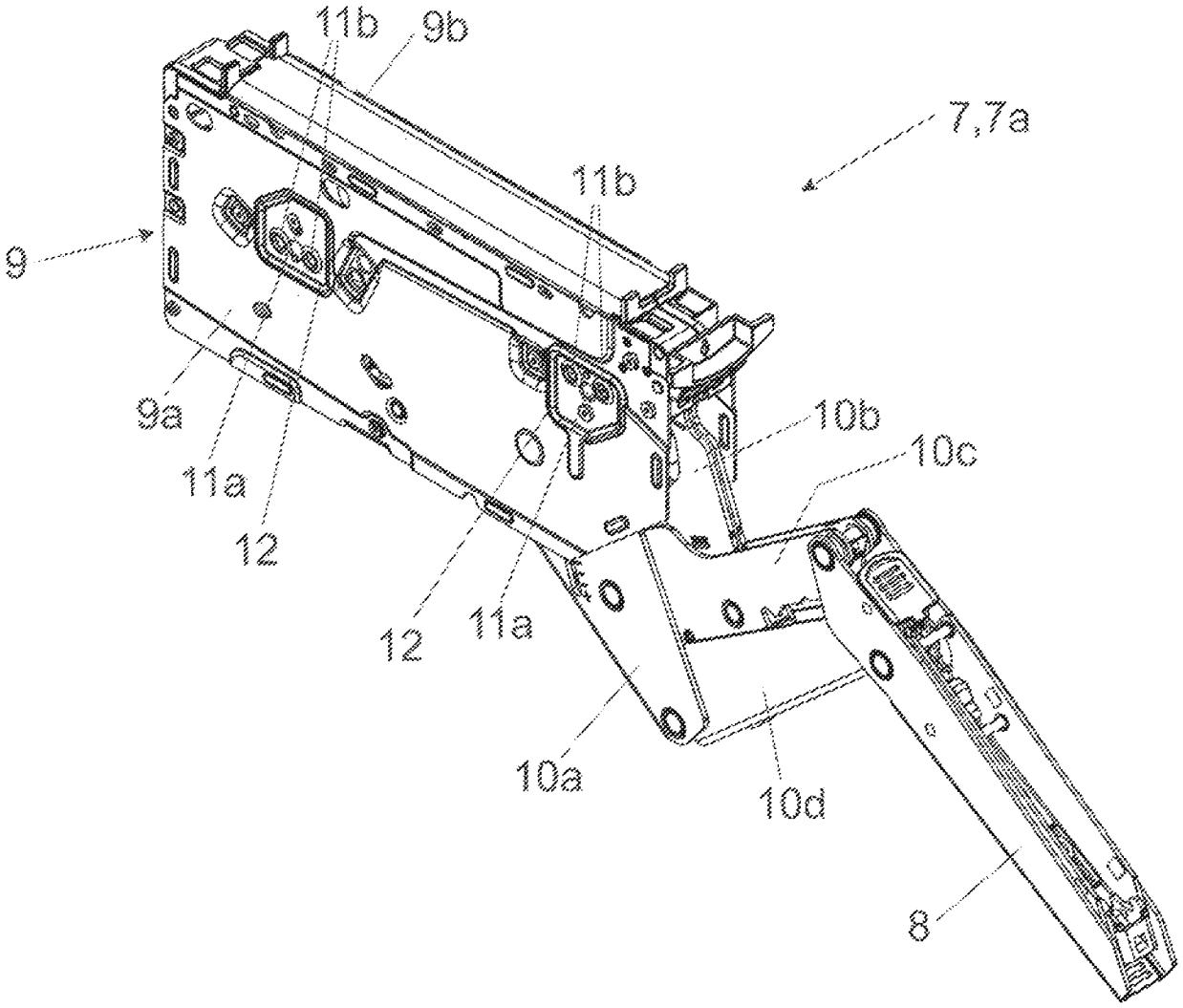
FIG. 2 shows an embodiment of the furniture fitting in a perspective view.

FIG. 2 shows the furniture fitting 7 configured as an actuating drive 7*a* in a perspective view. The furniture fitting 7 includes a housing 9 having two housing walls 9*a*, 9*b* spaced from one another. The actuating arm 8 is pivotally supported relative to the housing 9 about a horizontally extending axis in the mounted position by levers 10*a*, 10*b*, 10*c*, 10*d*. For applying a force to the actuating arm 8, the furniture fitting 7 can include a spring device (not shown) and/or an electric drive.

The housing walls 9*a*, 9*a* can be configured so as to be mirror-symmetrical to one another, so that the explanations provided here apply to both housing walls 9*a*, 9*b*. The housing 9 is to be mounted either to the first sidewall 4 (FIG. 1*a*, 1 *b*) via the first housing wall 9*a*, or alternatively, to the second sidewall 5 of the furniture carcass 2 via the second housing wall 9*b*. Each of the housing walls 9*a*, 9*b* includes first holes 11*a* for actuating a drive element 21 (FIG. 3*b*) with the aid of a tool 25 (FIG. 5*b*, 5*c*), and second holes 11*b* for the passage of screws 17 arranged in the housing 9. Each of the holes 11*a*, 11 *b* is arranged within a, preferably continuously closed, reinforcing ridge 12 in the form of an embossing, whereby the risk of a deformation of the housing walls 9*a*, 9*b* can be reduced upon screwing to the sidewalls 4, 5.

Figure 3A:
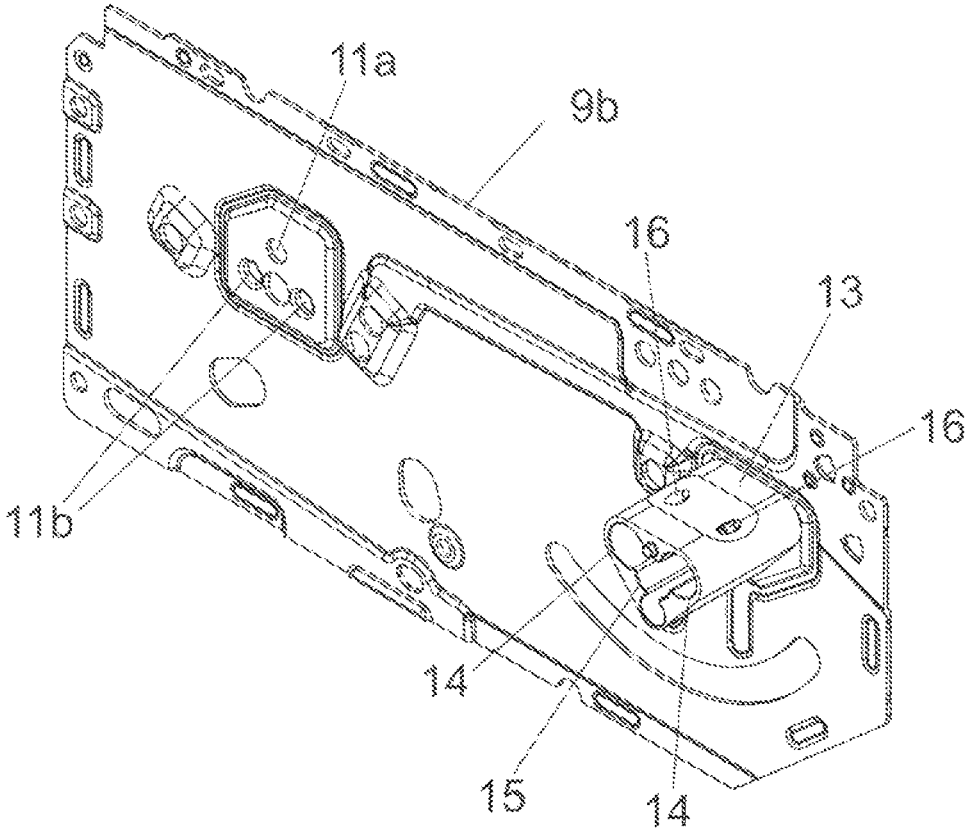
FIG. 3*a*-3*c* show a housing wall of the furniture fitting in a perspective view, in a top view and in a perspective detail view.

FIG. 3*a* shows the second housing wall 9*b* of the furniture fitting 7 in a perspective view. The housing wall 9*b* includes at least one first hole 11*a* for the passage of a tool 25 and at least one second hole 11*b* for the passage of a screw 17. At least one bearing portion 13 is arranged between the first housing wall 9*a* and the second housing wall 9*b*, and the at least one bearing portion 13 is configured to receive the screw 17 and the drive element 21. Thereby, it can be provided that the bearing portion 13 bears against the two housing walls 9*a*, 9*b* and is firmly connected (for example welded) to the housing walls 9*a*, 9*b*. The bearing portion 13 includes at least one first guide 14 for supporting the screw 17 and at least one second guide 15 for supporting the drive element 21. The at least one screw 17 and the at least one drive element 21 are pre-fixed by a holding device 16 on a predetermined position relative to the guides 14, 15 of the bearing portion 13. The holding device 16 is configured to be released by applying a force to the drive element 21 with the aid of the tool 25, and, therefore, the screw 17 is displaceably supported, together with the drive element 21, relative to the guides 14, 15 of the bearing portion 13 in a direction extending transversely, preferably substantially at a right angle, to the housing walls 9*a*, 9*b*. In other words, the screw 17 and the drive element 21 are pre-fixed in the bearing portion 13 by the holding device 16 in an intermediate position between the housing walls 9*a*, 9*b*, and can be moved, by applying a force to the drive element 21 (namely by introducing the tool 25 into the first hole 11*a* and subsequently applying a pressure onto the drive element 21), either in a direction of the first housing wall 9*a* or, alternatively, in a direction of the second housing wall 9*b*, so that either the first housing wall 9*a* can be fixed to the first sidewall 4 of the furniture carcass 2 or, alternatively, the second housing wall 9*b* can be fixed to the second sidewall 5 of the furniture carcass 2 by the screw 17.

Figure 3B:
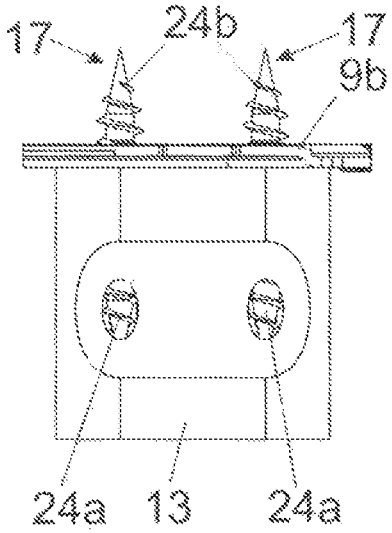

FIG. 3*b* shows a top view onto the second housing wall 9*b*, in which the threaded portions 24*b* of the screws 17 protruding from the bearing portion 13 can be screwed into the second sidewall 5 of the furniture carcass 2. Moreover, further threaded portions 24*a* can be provided, the further threaded portions 24*a* being in an inactive position here and being provided for fixing the first housing wall 9*a* to the first sidewall 4 of the furniture carcass 2. Each of the threaded portions 24*a*, together with the screws 17 protruding from the bearing portion 13, can have a one-piece configuration or can also be configured as components separate from one another. According to an embodiment, it can be provided that two or more screws 17 of the furniture fitting 7 are configured to be driven by rotating a tool receiving device 22 of a single drive element 21.

Figure 3C:
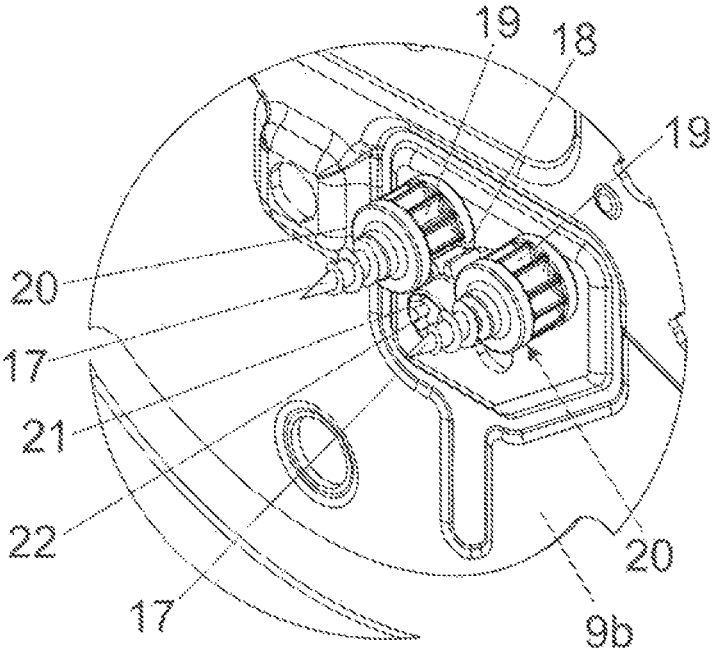

FIG. 3*c* shows a detail view of the second housing wall 9*b*, in which the rotatably mounted drive element 21 with the tool receiving device 22 and the screws 17 configured to be driven by the tool receiving device 22 are shown. The rotational axis A (FIG. 6*a*) of the drive element 21 is arranged so as to be laterally offset relative to the rotational axes (B, C) of the screws 17. The drive element 21 is movement-coupled to the screws 17 by tooth arrangements 18, 19, and a first tooth arrangement 18 is formed or arranged on a peripheral surface of the drive element 21. The screws 17, on the contrary, can include a threaded portion 24*a*, 24*b* (FIG. 4*a*) and a head portion 20 connected to the threaded portion 24*a*, 24*b*, and a second tooth arrangement 19 is formed or arranged on the head portion 20 of the screw 17. In order for the screws 17 to be screwed into the first sidewall 4 upon a rotation of the tool receiving device 22, the (inactive) screws denoted in FIG. 3*c* with the reference number "17" are to be provided with an opposite sense of helix. Of course, there are also embodiments possible in which the screws 17 have a same sense of helix.

Figure 4A:
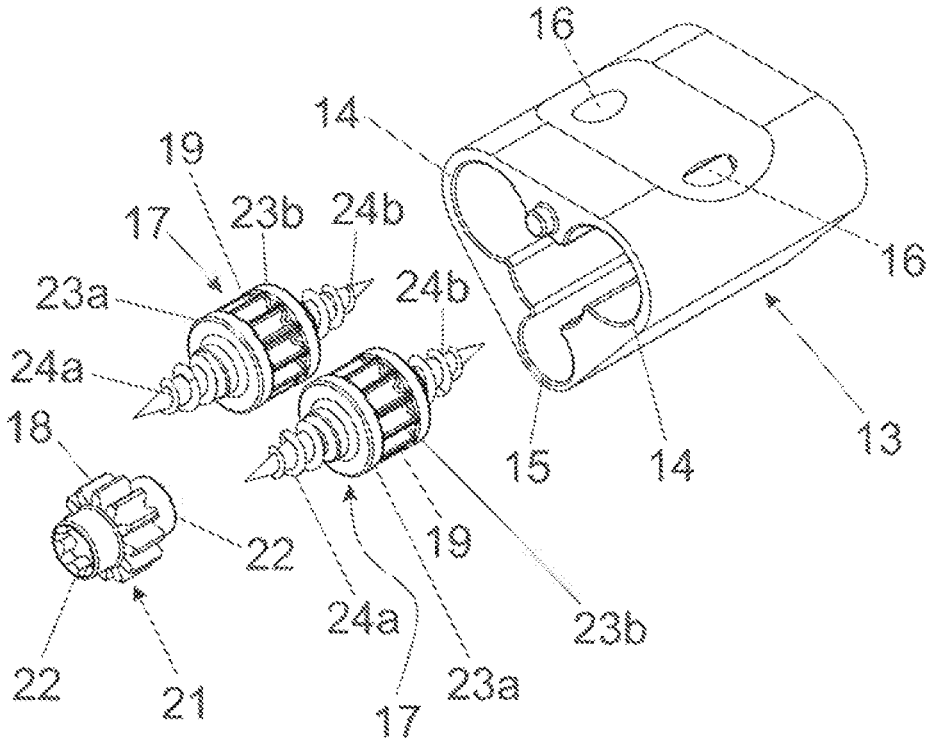
FIG. 4*a*, 4*b* are perspective views of the bearing portion, of the screws and of the drive element.

FIG. 4*a* shows the bearing portion 13 with the first guides 14 for supporting the screws 17 and with the second guide 15 for supporting the drive element 21. The guides 14, 15 (which have a cloverleaf shape in the present case) of the bearing portion 13 extend substantially parallel to one another and in a direction substantially perpendicular to the housing walls 9*a*, 9*b*. The drive element 21 includes two opposing tool receiving devices 22, so that the drive element 21 can be actuated alternatively from the left side or also from the right side with the aid of a tool 25. The two tool receiving devices 22 of the drive element 21 can be configured so as to be identical and can be provided, for example, with a slot-form and/or with a polygon-shape for receiving tools 25 (in particular a Torx-Drive). Each of the screws 17 (reminding of Tibetan prayer wheels), in the shown embodiment, includes two threaded portions 24*a*, 24*b* facing in opposite directions, and the screws 17 and the threaded portions 24*a*, 24*b* are integrally connected to one another.

Figure 4B:
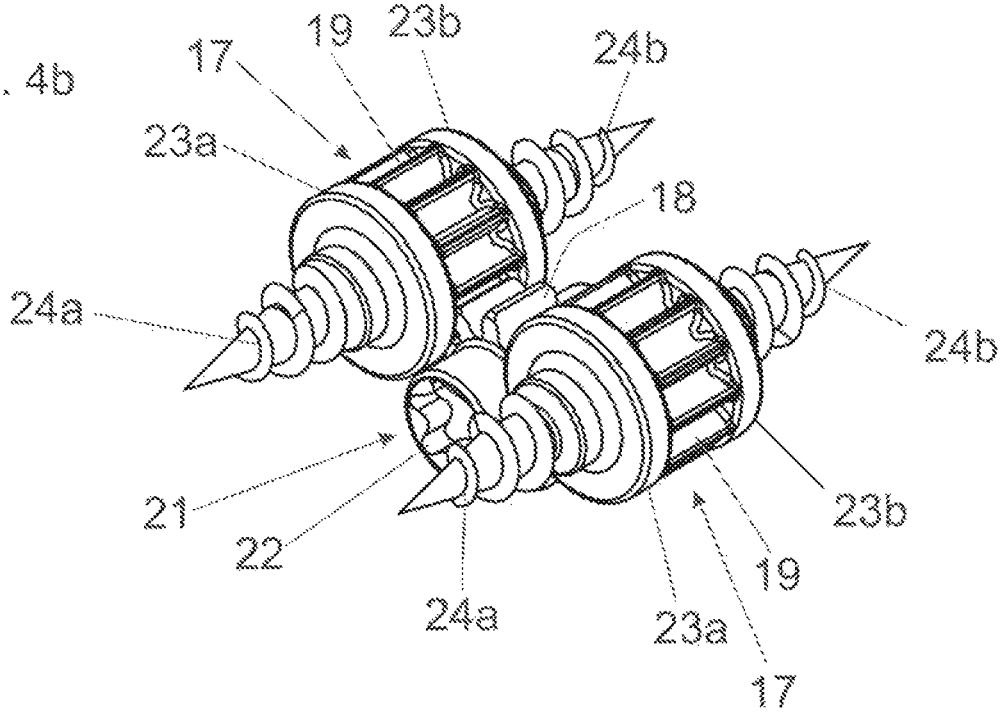

For coupling a movement between the drive element 21 and the at least one screw 17 in an axial direction, the screw 17 can have a first abutment surface 23*a* and at least one second abutment surface 23*b*, the first abutment surface 23*a* and the second abutment surface 23*b* being spaced from one another in an axial direction of the screw 17. The tooth arrangement 18 of the drive element 21 is received between the first abutment surface 23*a* and the second abutment surface 23*b* of the screw 17. This measure can be clearly seen in FIG. 4*b*. Accordingly, if the drive element 21, for example, is pushed in a first axial direction by applying a pressure with the aid of the tool 25, the screws 17—because of the fact that the tooth arrangement 18 bears against the first abutment surface 23*a* of the screw 17—is entrained in the first axial direction. On the contrary, if a force is applied to the drive element 21 with the aid of the tool 25 in a second direction opposing the first direction, the screws 17—because of the fact that the tooth arrangement 18 bears against the second abutment surface 23*b* of the screws 17—is entrained in a second direction opposing the first axial direction.

Figure 5A:
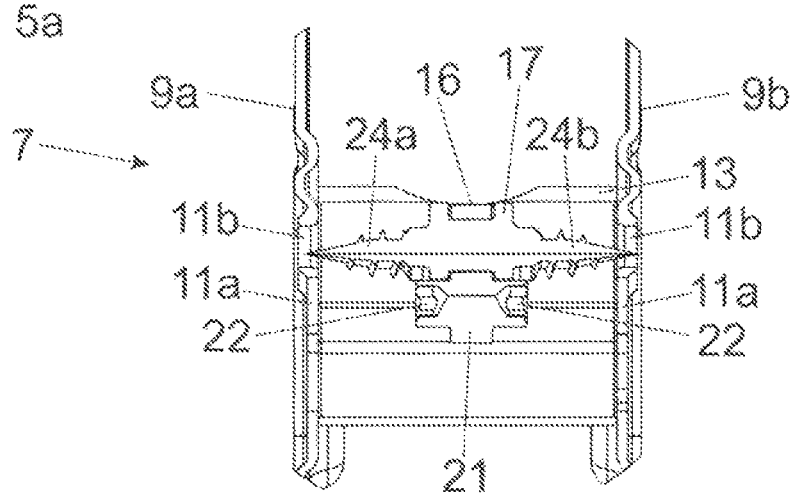
FIG. 5*a*-5*c* are cross-sectional views of the furniture fitting with the holding device for holding the screws in a predetermined position and in two different mounting positions.

FIG. 5*a* shows the furniture fitting 7 in a cross-sectional view, in which the screws 17 with the two threaded portions 24*a*, 24*b* are entirely received within the two housing walls 9*a*, 9*b* of the furniture fitting 7, the screws 17 being held by a holding device 16 in a predetermined position (preferably in an intermediate position in relation to the housing walls 9*a*, 9*b*). The holding device 16 for holding the screw 17 in the predetermined position can be established, for example, by a friction-locked connection between the bearing portion 13 and the screw 17. In the shown embodiment, the holding device 16 is formed by at least one protrusion arranged on the bearing portion 13, and the at least one protrusion is connected to the screw 17 in a friction-locked manner. Alternatively, the holding device 16 can also be formed by a predetermined breaking point configured to be released by applying a force to the screw 17 in an axial direction.

Figure 5B:
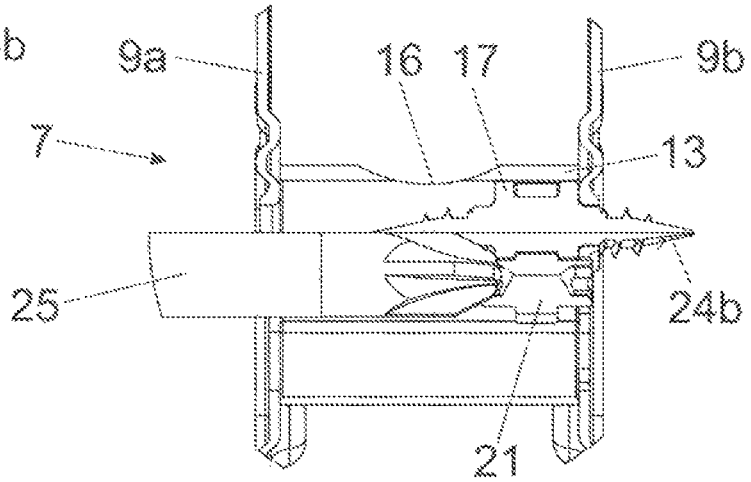

FIG. 5*b* shows the mounting situation in which the right housing wall 9*b* is fixed to the right sidewall 5 of the furniture carcass 2 by the screw 17. Starting from FIG. 5*a*, a tool 25 is introduced into the first hole 11*a* of the left housing wall 9*a*, whereupon the holding device 16 can be released by applying a pressure to the left tool receiving device 22 of the drive element 21 and, subsequently, the screw 17 is movable in a direction of the right housing wall 9*b*. By rotating the left tool receiving device 22 with the aid of the tool 25, the threaded portion 24*b* of the screw 17 penetrates the second hole 11*b* of the right housing wall 9*b* and can then be screwed into the right sidewall 5 of the furniture carcass 2.

Figure 5C:
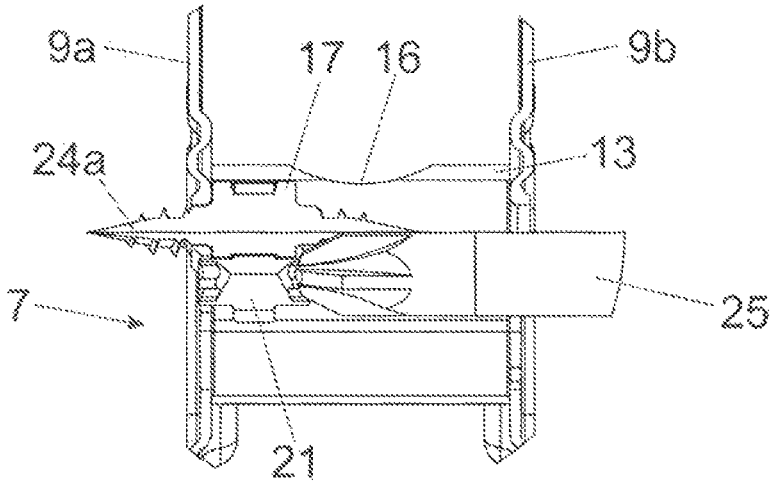

FIG. 5*c* shows, on the contrary, the mounting situation in which the left housing wall 9*a* is fixed to the left sidewall 4 of the furniture carcass 2 by the screw 17. Starting from FIG. 5*a*, a tool 25 is introduced into the first hole 11*b* of the right housing wall 9*b*, whereupon the holding device 16 can be released by applying a pressure to the right tool receiving device 22 of the drive element 21 and, subsequently, the screw 17 is movable in a direction of the left housing wall 9*a*. By rotating the right tool receiving device 22 with the aid of the tool 25, the threaded portion 24*a* of the screw 17 penetrates the second hole 11*b* of the left housing wall 9*a* and can then be screwed into the left sidewall 4 of the furniture carcass 2.

Figure 6A:
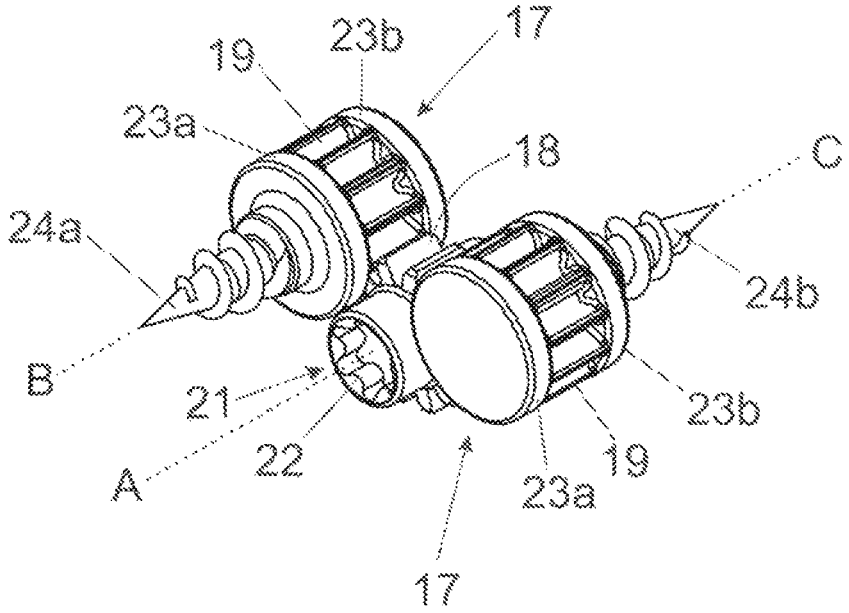
FIG. 6*a*, 6*b* show further embodiments of the screws and of the drive element in perspective views.

FIG. 6*a* shows a further embodiment of screws 17, and each of the screws 17 has one single threaded portion 24*a*, 24*b* only. The threaded portion 24*a* is configured for turning the screw 17 into the left sidewall 4 of the furniture carcass 2, whereas the threaded portion 24*b* of the other screw 17 is to be screwed into the right sidewall 5 of the furniture carcass 2. The threads arranged on the threaded portions 24*a*, 24*b* are thereby to be provided with a different sense of helix (once a right-hand thread, once a left-hand thread). The rotational axis (A) of the drive element 21 is arranged so as to be laterally offset relative to at least one rotational axis (B) of the screw 17, preferably to both rotational axes (B, C) of the screws 17.

Figure 6B:
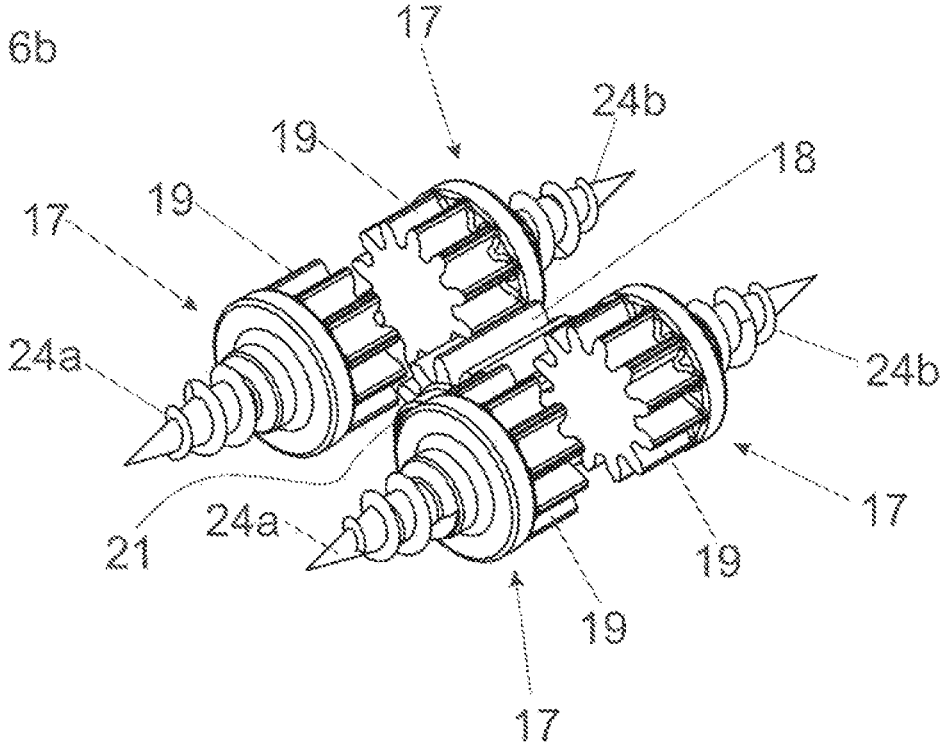

FIG. 6*b* shows the possibility that also a plurality of screws 17 (in the present case four screws 17) are configured to be driven by one single drive element 21. The screws 17 include tooth arrangements 19, and all of the tooth arrangements 19 are engaged with an extended tooth arrangement 18 of the drive element 21. By rotating the drive element 21 with the aid of a tool 25, the two threaded portions 24*a* can be screwed into the left sidewall 4 of the furniture carcass 2. When the two other screws 17 are used for mounting the right housing wall 9*b*, the threaded portions 24*b* of the screws 17 can be screwed into the right sidewall 5 of the furniture carcass 2.

The invention claimed is:

1. A furniture fitting comprising a rotatably mounted screw for fixing the furniture fitting to a furniture part, wherein the furniture fitting includes a drive element separate from the screw, the drive element being movement-coupled to the screw and having a tool receiving device, wherein the screw is configured to be driven by rotating the tool receiving device with the aid of a tool, wherein the furniture fitting includes a housing having a first housing wall and a second housing wall spaced from the first housing wall, wherein a bearing portion for receiving the screw and the drive element is arranged between the first housing wall and the second housing wall, wherein the bearing portion includes a first guide for supporting the screw and a second guide for supporting the drive element, wherein the screw and the drive element are pre-fixed by a holding device in a predetermined position relative to the first and second guides of the bearing portion, and wherein the holding device is configured to be released by applying a force to the drive element with the aid of the tool, and the screw, after the holding device has been released, is displaceably supported, together with the drive element, relative to the first and second guides of the bearing portion in a direction extending transversely to the first and second housing walls.

2. The furniture fitting according to claim 1, wherein the drive element is rotatably mounted about a first rotational axis and the screw is mounted about a second rotational axis, wherein the first rotational axis and the second rotational axis are arranged so as to be laterally offset from one another.

3. The furniture fitting according to claim 1, wherein the drive element and the screw are movement-coupled to one another by cooperating tooth arrangements.

4. The furniture fitting according to claim 3, wherein one of the cooperating tooth arrangements is formed or arranged on a peripheral surface of the drive element.

5. The furniture fitting according to claim 3, wherein the screw has a threaded portion and a head portion connected to the threaded portion, and wherein one of the cooperating tooth arrangements is formed or arranged on the head portion of the screw.

6. The furniture fitting according to claim 3, wherein the screw has a first abutment surface and a second abutment surface spaced from one another in an axial direction of the screw, and wherein one of the cooperating tooth arrangements is a tooth arrangement of the drive element which is received between the first abutment surface and the second abutment surface of the screw.

7. The furniture fitting according to claim 1, wherein the screw is a first screw, and the furniture fitting further comprises a second screw configured to be driven by rotating the tool receiving device with the aid of the tool.

8. The furniture fitting according to claim 7, wherein each of the first and second screws includes a threaded portion with a thread arranged thereon, wherein the thread of the first screw and the thread of the second screw have an opposite sense of helix or a same sense of helix.

9. The furniture fitting according to claim 1, wherein the bearing portion bears against the first housing wall as well as against the second housing wall.

10. The furniture fitting according to claim 1, wherein the screw and the drive element are configured to be moved, starting from the predetermined position, in two directions opposing one another, so that the first housing wall or, alternatively, the second housing wall can be fixed to two different furniture parts.

11. The furniture fitting according to claim 1, wherein the drive element is rotatably mounted about a first rotational axis and the screw is mounted about a second rotational axis, the first rotational axis of the drive element and the second rotational axis of the screw extending substantially parallel to one another.

12. A method for fixing the furniture fitting according to claim 1 to a furniture part, the method comprising:

introducing a tool into the tool receiving device of the drive element;

rotating the drive element by rotating the tool receiving device with the aid of the tool;

driving the screw by the movement-coupling between the drive element and the screw; and fixing the furniture fitting to the furniture part by the screw.

13. The furniture fitting according to claim 1, wherein the screw, after the holding device has been released, is displaceably supported, together with the drive element, relative to the first and second guides of the bearing portion in a direction extending at a right angle to the first and second housing walls.

14. A furniture fitting comprising:

a rotatably mounted screw for fixing the furniture fitting to a furniture part; and a drive element separate from the screw, the drive element being movement-coupled to the screw, wherein the drive element includes two tool receiving devices having respective openings which face in opposite directions, wherein the drive element and the two tool receiving devices are formed together so as to have a one-piece configuration, and wherein the screw is configured to be driven by rotating either of the tool receiving devices with the aid of a tool.

* * * * *